US011965254B2

(12) United States Patent
Lee et al.

(10) Patent No.: US 11,965,254 B2
(45) Date of Patent: Apr. 23, 2024

(54) MANUFACTURING APPARATUS AND MANUFACTURING METHOD FOR SYNTHETIC GAS WITH CONTROLLED $H_2$/CO RATIO

(71) Applicant: GWANGJU INSTITUTE OF SCIENCE AND TECHNOLOGY, Gwangju (KR)

(72) Inventors: Jaeyoung Lee, Gwangju (KR); Minjun Choi, Gwangju (KR); Jin Won Kim, Gwangju (KR); Sungyool Bong, Gwangju (KR); Youjin Lee, Gwangju (KR); Sunki Chung, Gwangju (KR)

(73) Assignee: GWANGJU INSTITUTE OF SCIENCE AND TECHNOLOGY (KR)

( * ) Notice: Subject to any disclaimer, the term of this patent is extended or adjusted under 35 U.S.C. 154(b) by 0 days.

(21) Appl. No.: 17/871,783

(22) Filed: Jul. 22, 2022

(65) Prior Publication Data

US 2023/0102211 A1 Mar. 30, 2023

(30) Foreign Application Priority Data

Sep. 30, 2021 (KR) ..... 10-2021-0129383
Mar. 15, 2022 (KR) ..... 10-2022-0032182

(51) Int. Cl.
*C25B 1/23* (2021.01)
*C25B 9/19* (2021.01)
(Continued)

(52) U.S. Cl.
CPC ..... *C25B 1/23* (2021.01); *C25B 9/19* (2021.01); *C25B 11/032* (2021.01);
(Continued)

(58) Field of Classification Search
None
See application file for complete search history.

(56) References Cited

U.S. PATENT DOCUMENTS

2017/0321334 A1* 11/2017 Kuhl ..... C25B 13/08
2021/0140056 A1* 5/2021 Jiao ..... C25B 9/19
2022/0259745 A1* 8/2022 Danyi ..... C25B 1/04

FOREIGN PATENT DOCUMENTS

KR 101764797 B1 * 8/2017

OTHER PUBLICATIONS

Machine translation of Kim, KR 101764797 B1 (Year: 2017).*

* cited by examiner

*Primary Examiner* — Wojciech Haske
(74) *Attorney, Agent, or Firm* — Renaissance IP Law Group LLP

(57) ABSTRACT

The present invention relates to a manufacturing apparatus and method for customizing a $H_2$/CO synthetic gas in a desired ratio by producing a synthetic gas in which $H_2$ and CO are mixed through hydrolysis of both carbon dioxide and a nitrogen compound with low power. In a low-power electrochemical apparatus for producing a synthetic gas according to the present invention, by performing the reduction of the carbon dioxide at the cathode and the oxidation of the nitrogen compound at the anode at the same time, carbon dioxide conversion efficiency may be improved 30% or more compared to the conventional carbon dioxide conversion system, and a synthetic gas with a desired $H_2$/CO ratio may be produced by controlling the $H_2$/CO ratio of the produced synthetic gas, and by reducing a driving voltage, the corrosion problem of electrode materials may be inhibited and the durability of electrodes may be increased.

9 Claims, 8 Drawing Sheets

(51) Int. Cl.

| | |
|---|---|
| ***C25B 11/032*** | (2021.01) |
| ***C25B 11/052*** | (2021.01) |
| ***C25B 11/081*** | (2021.01) |
| ***C25B 15/08*** | (2006.01) |

(52) U.S. Cl.
CPC ..... *C25B 11/052* (2021.01); *C25B 11/081* (2021.01); *C25B 15/08* (2013.01)

MANUFACTURING APPARATUS AND MANUFACTURING METHOD FOR SYNTHETIC GAS WITH CONTROLLED $H_2$/CO RATIO

CLAIM FOR PRIORITY

This application claims priority to Korean Patent Application No. 2021-0129383 filed on Sep. 30, 2021 and Korean Patent Application No. 2022-0032182 filed on Mar. 15, 2022 in the Korean Intellectual Property Office (KIPO), the entire contents of which are hereby incorporated by reference.

BACKGROUND

1. Technical Field

This invention relates to an electrochemical apparatus for producing a synthetic gas, and more particularly, to a manufacturing apparatus and method for customizing a $H_2$/CO synthetic gas in a desired ratio by producing a synthetic gas in which $H_2$ and CO are mixed through simultaneous hydrolysis of carbon dioxide and a nitrogen compound with low power.

2. Related Art

With the development of industry, the amount of carbon dioxide emission is increasing, and the concentration of carbon dioxide in the air has been steadily increasing since the industrial revolution. The increase in population and the increase in the amount of fossil fuels used according to the development of industry caused a sharp increase in the amount of carbon dioxide emission, resulting in various environmental impacts such as global warming, ocean acidification, etc.

To develop a technology of effectively reducing carbon dioxide, various studies related to technologies of capturing and storing carbon dioxide have been conducted, and recently, technology for converting carbon dioxide into other high value-added energy resources, for example, carbon monoxide and ethanol, is also being developed.

Among these technologies, the electrochemical conversion of carbon dioxide can be performed under room temperature and atmospheric pressure conditions and has the advantage of modularization with a simple system.

In the current carbon dioxide conversion system, as a pair reaction of carbon dioxide reduction, an oxygen evolution reaction (OER) is applied. Accordingly, the reaction scheme of the conventional carbon dioxide conversion system is the same as the following Reaction Formula 1:

Cathode: $CO_2+H_2O+2e^- \rightarrow CO(g)+H_2O$ (−0.53 V vs. RHE)

Anode: $H_2O \rightarrow \frac{1}{2}O_2+2H^++2e^-$ (1.23 V vs. RHE) [Reaction Scheme 1]

Here, the theoretical on-set voltage of the conventional carbon dioxide conversion system in Reaction Scheme 1 is −1.76V, and due to the high chemical stability of carbon dioxide, there is the disadvantage in that a large amount of electrical energy has to be consumed.

The equation relating to the amount of theoretical energy consumption is the same as the following Equation 1.

$$\text{Energy consumption } (W) = \text{current } (I) \times \text{voltage } (V) \quad \text{[Equation 1]}$$

Therefore, referring to Equation 1, when the driving voltage of the current carbon dioxide conversion system can be reduced, a high amount of energy consumption, which is the problem of the related art, can be reduced. Therefore, there is an urgent demand for the development of a highly efficient carbon dioxide conversion system that can reduce a driving voltage.

Meanwhile, a method of producing a synthetic gas, which is a mixture of CO and $H_2$ gases by electrically converting carbon dioxide is being studied. The synthetic gas may produce hydrocarbon intermediates of low-cost alkanes such as ethylene, propylene and butene isomers through a Fischer-Tropsch (F-T) reaction, and such hydrocarbon intermediates of alkanes may be converted into industrial olefin products such as a linear alpha-olefin oligomer or ester-type synthetic lubricating oil in the presence of a suitable catalyst, and may also be used in synthesis of a liquid fuel such as methanol.

Here, since a $H_2$/CO ratio is very important for a F-T reaction and methanol synthesis due to flexibility of a fuel composition and operating conditions, a method that can control a synthetic gas having a desired $H_2$/CO ratio is required.

SUMMARY

To improve the disadvantages and problems of the related art as described above, example embodiments of the present invention provide a low-power electrochemical apparatus for producing a synthetic gas, which is able to produce a synthetic gas having a desired $H_2$/CO ratio.

Example embodiments of the present invention also provide a method of producing a $H_2$/CO ratio-controlled synthetic gas using the low-power electrochemical apparatus for producing a synthetic gas.

However, technical problems to be solved in the present invention are not limited to the above-described problems, and other problems which are not described herein will be fully understood by those of ordinary skill in the art to which the present invention belongs from the following descriptions.

In one example embodiment, a low-power electrochemical apparatus for producing a synthetic gas is provided. The low-power electrochemical apparatus for producing a synthetic gas includes a cathode unit, which includes a first supply unit for supplying a carbon dioxide-containing reduction fuel, a cathode for reducing the carbon dioxide, a catholyte spacer in contact with the cathode and containing a catholyte, and a first outlet located at one end of the catholyte spacer and discharging a synthetic gas by reducing carbon dioxide; an anode unit, which includes a second supply unit for supplying an oxidation fuel containing a nitrogen compound, an anode for oxidizing the nitrogen compound, an anolyte spacer in contact with the anode and containing an anolyte, and a second outlet located at one end of the anolyte spacer and discharging a nitrogen compound-containing oxidation product; an ion exchange unit which includes an ion exchange membrane interposed between the catholyte spacer and the anolyte spacer; and a power unit for supplying power to the cathode and the anode.

The first supply unit may be a bipolar plate having a reduction fuel inlet and a flow channel, and the second supply unit may be a bipolar plate having an oxidation fuel inlet, a flow channel and an oxidation fuel outlet.

The bipolar plate may be at least one selected from the group consisting of graphite, aluminum (Al), stainless steel (SUS), titanium (Ti), gold (Au), and a combination thereof.

The cathode and the anode may be gas diffusion electrodes including a catalyst layer.

The catalyst layer of the cathode may be at least one selected from a metal or metal oxide selected from the group consisting of Cu, Au, Ag, Zn, Sn, Pb, In, Hg, CuO and $Cu_2O$, a metal-metal alloy, a metal-metal oxide alloy, and a carbon-supported metal.

The catalyst layer of the anode may be selected from Pt, Ir, Rh, Ru, Fe, Ni, $IrO_2$, $RuO_2$, a carbon-supported metal, and a combination thereof.

The nitrogen compound may be selected from the group consisting of ammonia ($NH_3$), urea, uric acid, biuret, dimethyl urea, hydrazine, urea formaldehyde ($H_2N$—$COONH_4$), $HNO_3$, $NO_2$, NO, $N_2O_3$, and a combination thereof.

The concentration of the nitrogen compound in the oxidation fuel may range from 0.1 to 30 wt %.

The catholyte and the anolyte may each be independently selected from the group consisting of $KHCO_3$, $K_2CO_3$, KOH, KCl, $KClO_4$, $K_2SiO_3$, $Na_2SO_4$, $NaNO_3$, NaCl, NaF, $NaClO_4$, $CaCl_2$, and a combination thereof.

The widths of the catholyte spacer and the anolyte spacer may be less than 10 cm.

The widths of the catholyte spacer and the anolyte spacer may be 5 cm or less.

The widths of the catholyte spacer and the anolyte spacer may be 1.5 cm or less.

The power unit may apply constant current having a current density of 1 mA $cm^{-2}$ to 10 A $cm^{-2}$.

In another example embodiment, a method of producing a $H_2$/CO ratio-controlled synthetic gas using the low-power electrochemical apparatus for producing a synthetic gas is provided. The method of producing a $H_2$/CO ratio-controlled synthetic gas includes providing the low-power electrochemical apparatus for producing a synthetic gas (S10); injecting a reduction fuel containing carbon dioxide into a first supply unit of the low-power electrochemical apparatus for producing a synthetic gas, and injecting an oxidation fuel containing a nitrogen compound into a second supply unit thereof (S20); and producing a synthetic gas containing $H_2$ and CO by converting both of the carbon dioxide and the nitrogen compound at the same time by applying a constant current to an anode and a cathode of the low-power electrochemical apparatus for producing a synthetic gas (S30), and the $H_2$/CO ratio-controlled synthetic gas is produced by adjusting the concentration of the injected nitrogen compound and the current density of the applied constant current.

The concentration of the nitrogen compound in the oxidation fuel may range from 0.1 to 30 wt %.

As the current density of the constant current may be used in the range of 1 mA $cm^{-2}$ to 10 A $cm^{-2}$, the $H_2$/CO ratio of the synthetic gas produced may be controlled to 0.25 to 30.

According to an embodiment of the present invention, oxygen generation reaction, which is an oxidation electrode reaction of a conventional carbon dioxide conversion system, is replaced with oxidation reaction of a nitrogen compound, and as the on-set voltage is lowered, thus the system can be driven with low power to effectively reduce the energy consumption. In addition, by occurring the reduction of the carbon dioxide at the cathode and the oxidation of the nitrogen compound at the anode, it can offer to remove carbon dioxide, which is a greenhouse gas, and nitrogen compounds, which are serious water pollution sources, and it can provide the effect of producing valuable synthetic gases.

In addition, In a low-power electrochemical apparatus for producing a synthetic gas according to the present invention, by performing the reduction of the carbon dioxide at the cathode and the oxidation of the nitrogen compound at the anode at the same time, carbon dioxide conversion efficiency may be improved 30% or more compared to the conventional carbon dioxide conversion system, and a synthetic gas with a desired $H_2$/CO ratio may be produced by controlling the $H_2$/CO ratio of the produced synthetic gas, and by reducing a driving voltage, the corrosion problem of electrode materials may be inhibited and the durability of electrodes may be increased.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS

Figure 1:
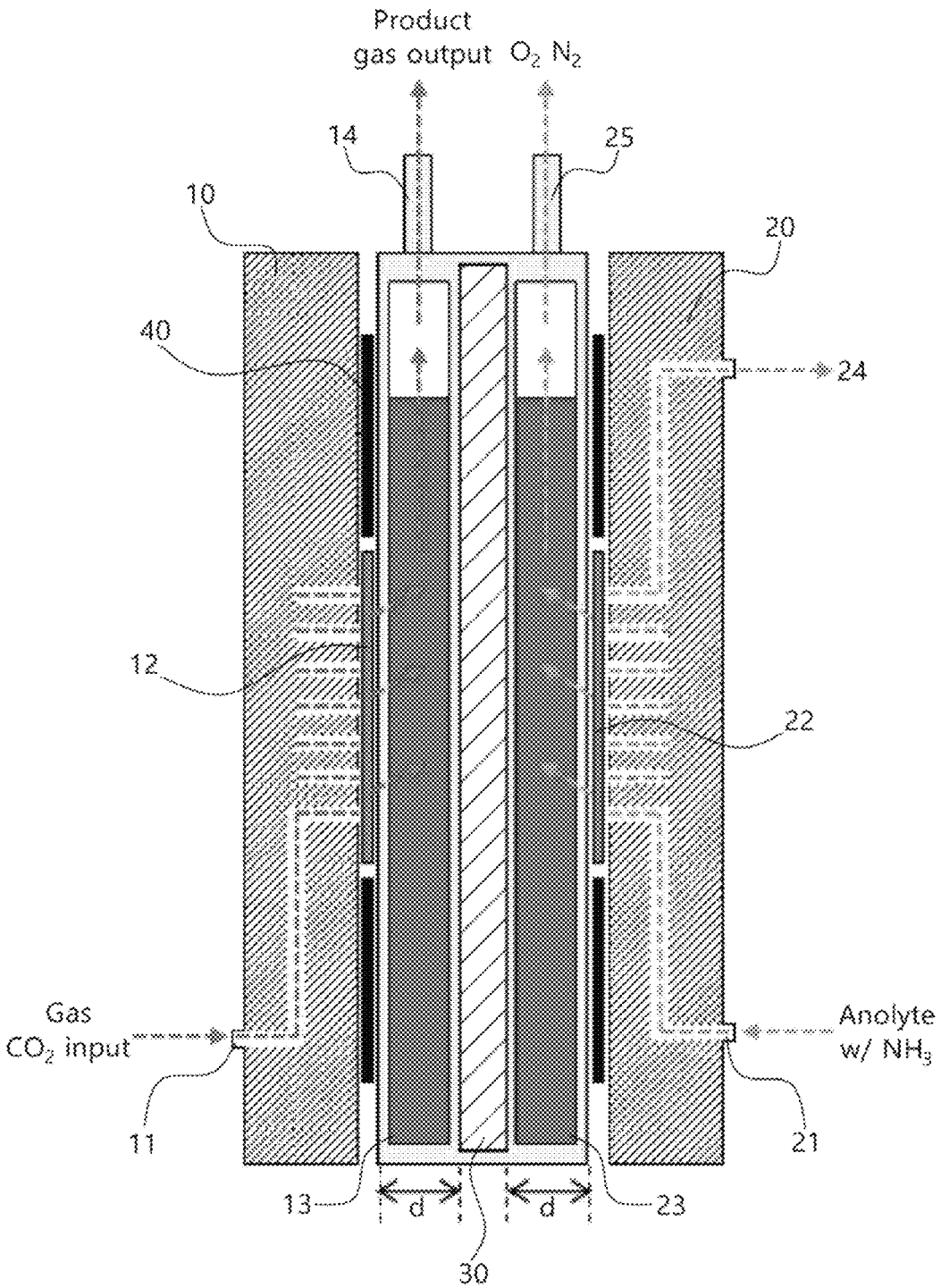
FIG. 1 is a schematic diagram of a low-power electrochemical apparatus for producing a synthetic gas according to an example embodiment of the present invention.

Hereinafter, the present invention will be described in detail with reference to the accompanying drawings. However, the present invention may be implemented in a variety of different forms, and is not limited to the embodiments described herein. In addition, for clear explanation of the present invention in the drawings, parts that are not related to the description are omitted, and like numerals denote like parts throughout the specification.

Throughout the specification, when a part is "connected (linked, in contact, or coupled)" with another part, it means that the one part is "directly connected," or "indirectly connected" with a third member therebetween. In addition, when a certain part "includes" a certain component, it means that, unless particularly stated otherwise, another component may be further included, rather than excluding the other component.

The terminology used herein is for the purpose of describing particular embodiments only and is not intended to be limiting of the invention. As used herein, the singular forms are intended to include the plural forms as well, unless the context clearly indicates otherwise. It will be further understood that the terms "comprise", "comprising,", "include" and/or "including", when used herein, specify the presence of stated features, numbers, steps, operations, elements, components or a combination thereof, but do not preclude the possibility of the presence or addition of one or more other features, numbers, steps, operations, elements, components or a combination thereof.

Hereinafter, example embodiments of the present invention will be described in detail with reference to the accompanying drawings.

One aspect of the present invention provides a low-power electrochemical apparatus for producing a synthetic gas.

FIG. 1 is a schematic diagram of a low-power electrochemical apparatus for producing a synthetic gas according to an example embodiment of the present invention.

Referring to FIG. 1, a low-power electrochemical apparatus for producing a synthetic gas according to the present invention includes

- a cathode unit, which includes a first supply unit for supplying a carbon dioxide-containing reduction fuel, a cathode for reducing the carbon dioxide, a catholyte spacer in contact with the cathode and containing a catholyte, and a first outlet located at one end of the catholyte spacer and discharging a synthetic gas by reducing carbon dioxide;
- an anode unit, which includes a second supply unit for supplying an oxidation fuel containing a nitrogen compound, an anode for oxidizing the nitrogen compound, an anolyte spacer in contact with the anode and containing an anolyte, and a second outlet located at one end of the anolyte spacer and discharging a nitrogen compound-containing oxidation product;
- an ion exchange unit which includes an ion exchange membrane interposed between the catholyte spacer and the anolyte spacer; and
- a power unit for supplying power to the cathode and the anode.

First, the low-power electrochemical apparatus for producing a synthetic gas of the present invention includes a cathode unit.

The cathode unit includes a first supply unit 10 for supplying a carbon dioxide-containing reduction fuel, a cathode 12 for reducing the carbon dioxide, a catholyte spacer 13 in contact with the cathode and containing a catholyte, and a first outlet 14 located at one end of the catholyte spacer and discharging a synthetic gas by reducing carbon dioxide.

In one example embodiment of the present invention, the first supply unit 10 serves to provide a reduction fuel containing carbon dioxide into the apparatus, and may have a bipolar plate with a reduction fuel inlet 11 and a flow channel to supply the reduction fuel to a cathode, but the present invention is not limited thereto. The first supply unit may be at least one selected from the group consisting of graphite, aluminum (Al), stainless steel (SUS), titanium (Ti), gold (Au), and a combination thereof.

The reduction fuel may use carbon dioxide alone, or may further include a first electrolyte.

In one example embodiment of the present invention, the first electrolyte may be any one selected from the group consisting of $KHCO_3$, $K_2CO_3$, KOH, KCl, $KClO_4$, $K_2SiO_3$, $Na_2SO_4$, $NaNO_3$, NaCl, NaF, $NaClO_4$, $CaCl_2$, and a combination thereof. The carbon dioxide may be gaseous or liquid. For example, gaseous or liquid carbon dioxide may be provided as a reduction fuel by the first supply unit 10. Alternatively, the gaseous carbon dioxide may be supplied in a solution state while being dissolved in the first electrolyte, for example, a $KHCO_3$ aqueous solution.

In one example embodiment of the present invention, the cathode 12 is an electrode at which a reduction reaction of the carbon dioxide supplied from the outside occurs, and a gas diffusion electrode (GDE) that is commonly used in the art may be used. The GDE is an electrode that allows the three phases of a material, such as a solid, a liquid and a gas, to be in contact with each other, and catalyzes an electrochemical reaction between a liquid and a gas. The GDE may be a porous electrode with a thickness of 100 to 200 μm, consisting of, for example, a carbon fiber, and a catalyst having activity in a reduction reaction of carbon dioxide may be present as a catalyst layer on the carbon fiber. The catalyst may be, for example, at least one of a metal or metal oxide selected from the group consisting of Cu, Au, Ag, Zn, Sn, Pb, In, Hg, CuO and $Cu_2O$, a metal-metal alloy, a metal-metal oxide alloy, and a carbon-supported metal. The catalyst layer may be formed using various catalyst-coated substrate (CCS) and catalyst-coated membrane (CCM) technologies, for example, a spray coating method, a decal method, a tape casting method (doctor blade method), an electro-deposition method, an electroless-deposition method and the like, but the present invention is not limited thereto.

In one example embodiment of the present invention, the catholyte spacer 13 is a space containing a catholyte, serving to increase the residence time of the catholyte in the apparatus, and located between the cathode and an ion exchange membrane to be described below. The first electrolyte may be previously loaded as a catholyte in the catholyte space, and as the reduction fuel is supplied, when a carbon dioxide-dissolved electrolyte comes into contact with the cathode, excess electrolyte may be moved to the catholyte spacer and loaded.

Figure 4:
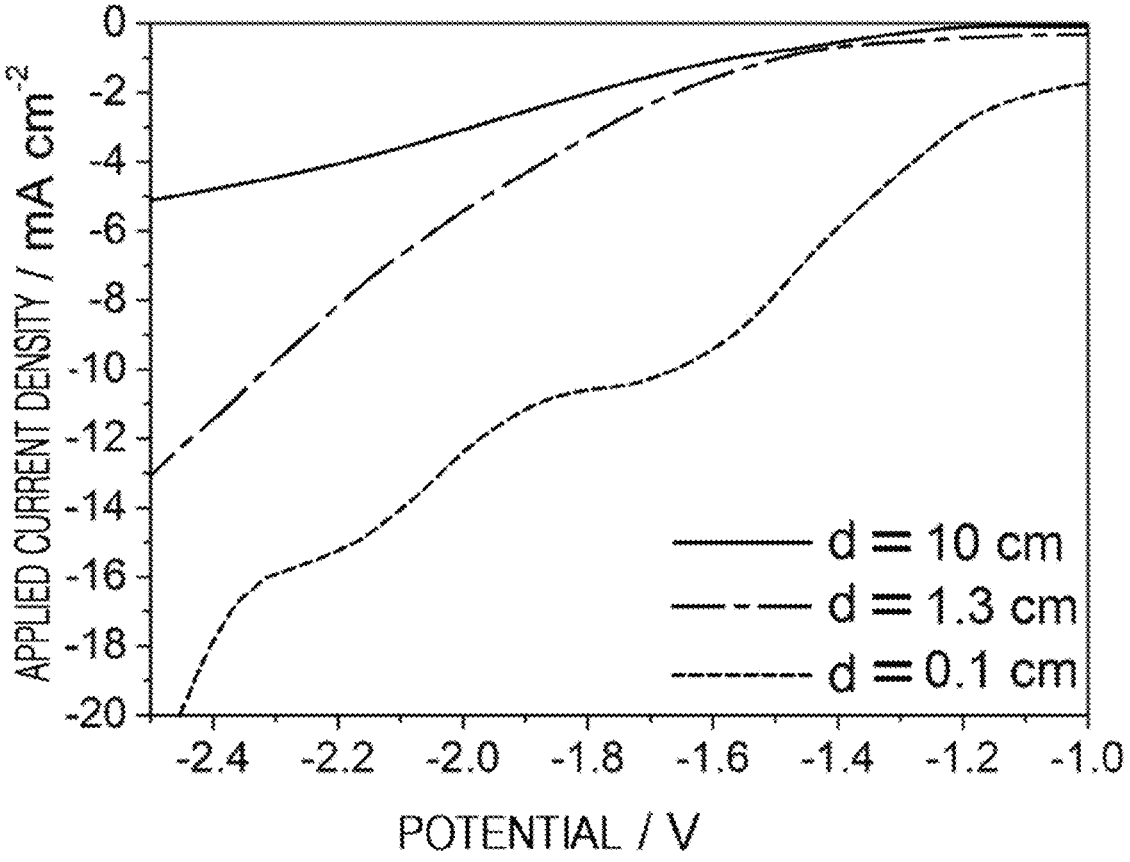
FIG. 4 is a graph showing changes in voltage and current density according to the distance (d) between an electrode and an ion exchange membrane in a low-power electrochemical apparatus for producing a synthetic gas according to one example embodiment of the present invention.

Here, the low-power electrochemical apparatus for producing a synthetic gas according to the present invention adjusts the width (d) of the catholyte spacer 13, that is, the distance between the cathode and the ion exchange membrane. As a result of measuring the change in voltage and current density according to the width (d) of the catholyte spacer 13, the inventors confirmed that, as shown in FIG. 4, when the width (d) is 10 cm, the current density is low even with an increase in voltage, whereas when the width (d) becomes smaller, the electrical conductivity is increased by increasing the size of the current density at the same voltage. Therefore, the width (d) of the catholyte spacer 13 is preferably less than 10 cm, and more preferably 5 cm or less, and even more preferably 1.5 cm or less.

At the interface between the catholyte spacer 13 and the cathode 12, carbon dioxide is reduced to produce a synthetic gas, which is a mixture of hydrogen ($H_2$) and carbon monoxide (CO), and thus a first outlet 14 that discharges the produced synthetic gas may be included at one end of the catholyte spacer 13.

In addition, the low-power electrochemical apparatus for producing a synthetic gas according to the present invention includes an anode unit.

The anode unit includes a second supply unit 20 supplying an oxidation fuel containing a nitrogen compound, an anode 22 at which the nitrogen compound is oxidized, an anolyte spacer 23 in contact with the anode and containing an anolyte, and a second outlet 25 located at one end of the anolyte spacer and discharging oxygen and nitrogen, which are formed by oxidizing the nitrogen compound.

In one example embodiment of the present invention, the second supply unit 20 serves to supply an oxidation fuel containing a nitrogen compound into the apparatus, and may have a bipolar plate with an oxidation fuel inlet 21, a flow channel and an oxidation fuel outlet 24 to supply the oxidation fuel to an anode in the apparatus, but the present invention is not limited thereto. The second supply unit may be at least one selected from the group consisting of graphite, aluminum (Al), stainless steel (SUS), titanium (Ti), gold (Au), and a combination thereof.

The oxidation fuel may be a solution in which a nitrogen compound is dissolved in a second electrolyte, or domestic wastewater or industrial wastewater containing a nitrogen compound, but the present invention is not limited thereto.

The nitrogen compound serves to lower an operating voltage when carbon dioxide is converted, and also plays an important role in adjusting $H_2$ and CO ratios in a synthetic gas produced by the carbon dioxide conversion.

Figure 5:
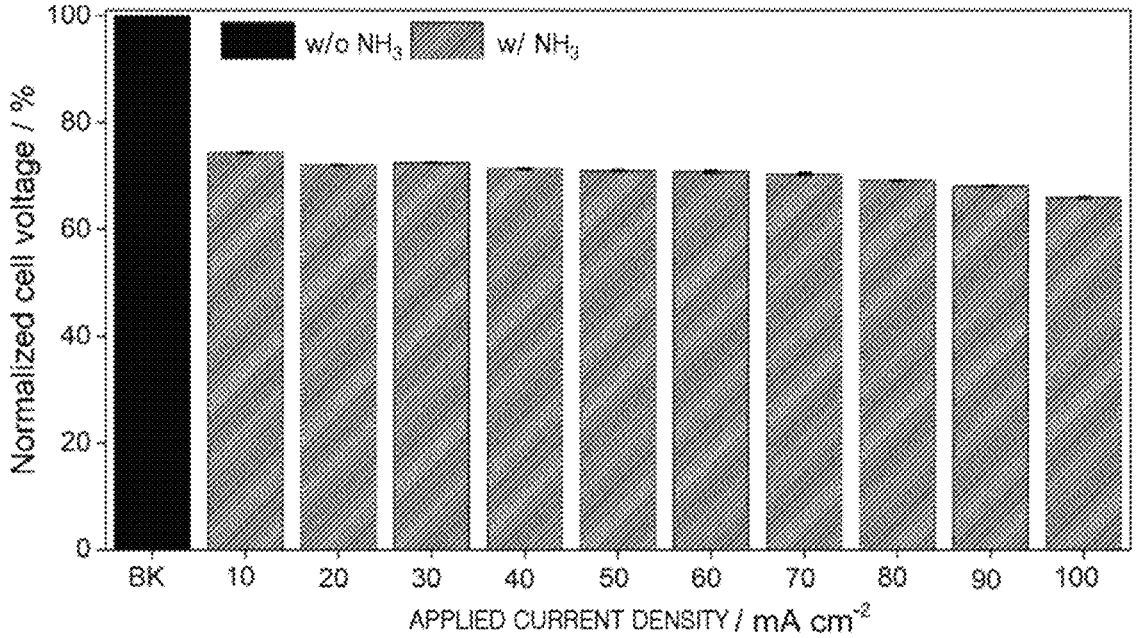
FIG. 5 is a graph showing a cell voltage by applied current density depending on the presence or absence of nitrogen compound ($NH_3$) contained in an anolyte in a low-power electrochemical apparatus for producing a synthetic gas according to one example embodiment of the present invention.
Figure 6:
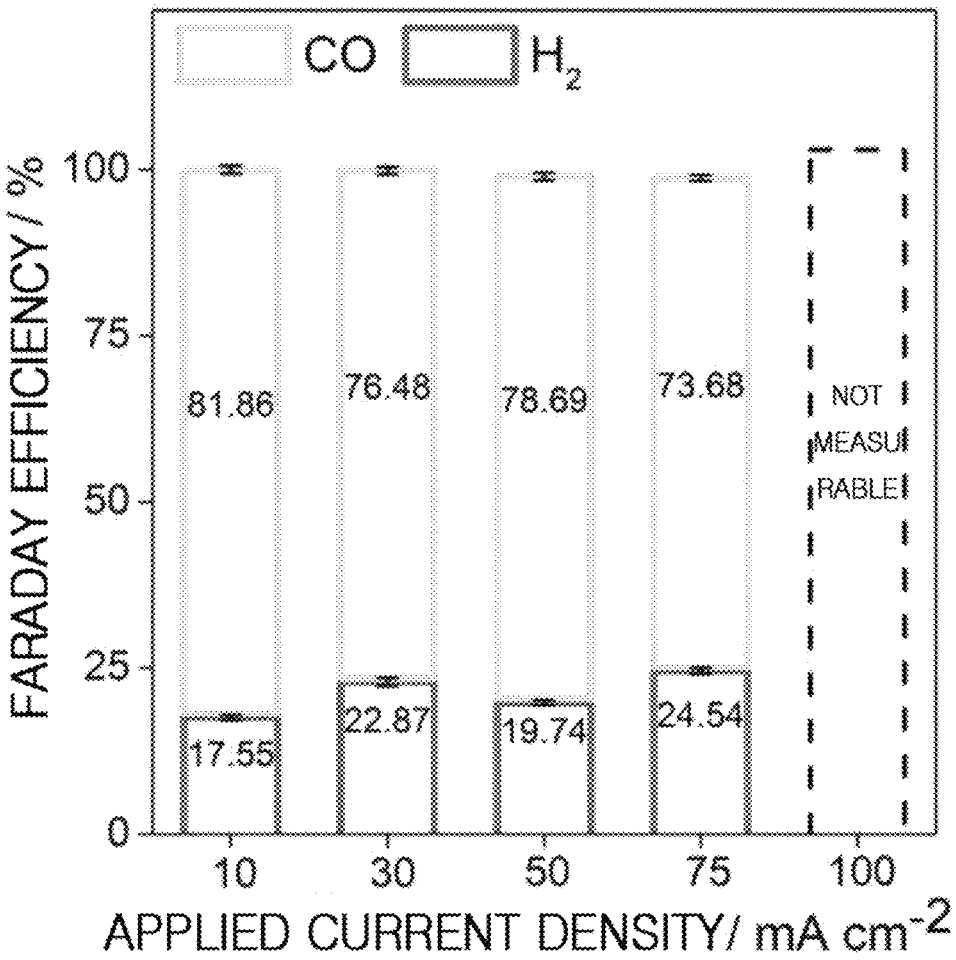
FIG. 6 is a graph showing a conversion rate of a synthetic gas ($H_2$/CO) by applied current density when a nitrogen compound ($NH_3$) is not contained in an anolyte in a low-power electrochemical apparatus for producing a synthetic gas according to one example embodiment of the present invention.
Figure 7:
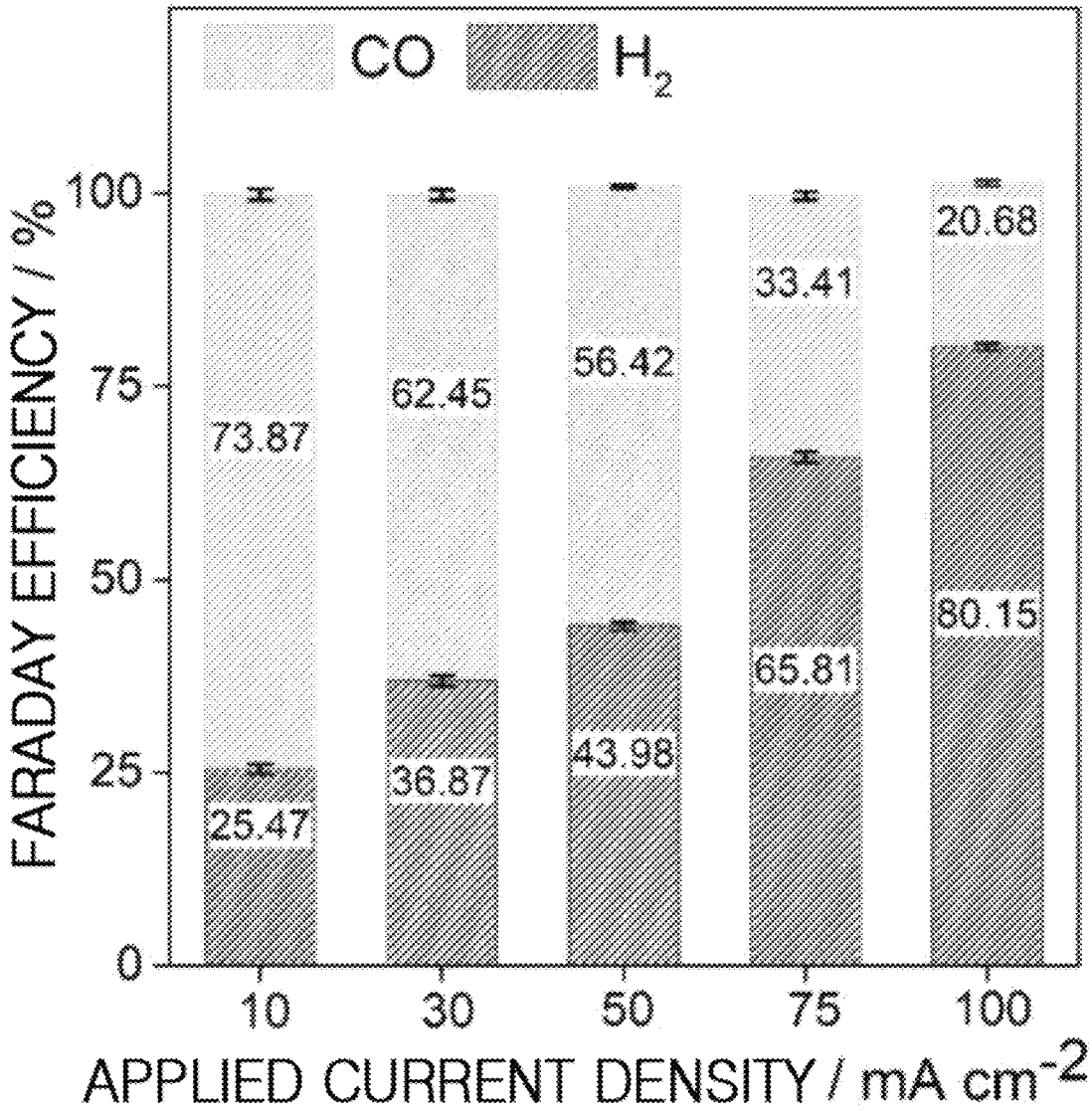
FIG. 7 is a graph showing a conversion rate of synthetic gas ($H_2$/CO) by applied current density when a 2M nitrogen compound ($NH_3$) is contained in an anolyte in a low-power electrochemical apparatus for producing a synthetic gas according to one example embodiment of the present invention.

To identify the effect of a nitrogen compound on the conversion of the carbon dioxide in the low-power electrochemical apparatus for producing a synthetic gas according to the present invention, as a result of measuring an operating voltage depending on the presence or absence of the nitrogen compound in the oxidation fuel injected into the anode and the conversion efficiency of the synthetic gas (hydrogen, carbon monoxide), the inventors confirmed that, as shown in FIG. 5, the operating voltage is lowered when the nitrogen compound is included compared to the case in which the nitrogen compound is not included in the oxidation fuel, and as shown in FIGS. 6 and 7, when the nitrogen compound is not included in the oxidation fuel, the $H_2$/CO ratio of the produced synthetic gas does not show a constant pattern regardless of the applied voltage. However, it was shown that when the nitrogen compound is included in the oxidation fuel, the $H_2$/CO ratio of the produced synthetic gas increases linearly with the applied voltage. Therefore, it can be demonstrated that the nitrogen compound is a very important factor that can adjust the $H_2$/CO ratio in the synthetic gas in the production of the synthetic gas in the low-power electrochemical apparatus for producing a synthetic gas according to the present invention.

In one example embodiment of the present invention, the nitrogen compound may be any one selected from the group consisting of ammonia ($NH_3$), urea, uric acid, biuret, dimethyl urea, hydrazine, urea formaldehyde ($H_2N$—$COONH_4$), $HNO_3$, $NO_2$, NO, $N_2O_3$, and a combination thereof.

In one example embodiment of the present invention, the second electrolyte may be any one selected from the group consisting of $KHCO_3$, $K_2CO_3$, KOH, KCl, $KClO_4$, $K_2SiO_3$, $Na_2SO_4$, $NaNO_3$, NaCl, NaF, $NaClO_4$, $CaCl_2$, and a combination thereof. The second electrolyte may be the same as or different from the first electrolyte.

For example, the oxidation fuel may be supplied in a solution state by dissolving ammonia ($NH_3$) in the second electrolyte, such as a $KHCO_3$ aqueous solution.

Here, since the concentration of the nitrogen compound in the oxidation fuel preferably ranges from 0.1 to 30 wt %, the $H_2$/CO ratio of the produced synthetic gas may be effectively adjusted within the range, and when outside the above range, there is a problem in that this action is not performed properly.

In one example embodiment of the present invention, the anode 22 is an electrode at which the oxidation reaction of a nitrogen compound supplied from the outside occurs, and a GDE which is commonly used in the art may be used. The GDE is an electrode that allows the three phases of a material, such as a solid, a liquid and a gas, to be in contact with each other, and catalyzes an electrochemical reaction between a liquid and a gas. The GDE may be a porous electrode with a thickness of 100 to 200 μm, consisting of, for example, a carbon fiber, and a catalyst having activity in an oxidation reaction of a nitrogen compound on the carbon fiber may be present as a catalyst layer on the carbon fiber. The catalyst may be selected from, for example, Pt, Ir, Rh, Ru, Fe, Ni, $IrO_2$, $RuO_2$, a carbon-supported metal, and a combination thereof. The catalyst layer may be formed using various catalyst-coated substrate (CCS) and catalyst-coated membrane (CCM) technologies, for example, a spray coating method, a decal method, a tape casting method (doctor blade method), an electro-deposition method, an electroless-deposition method and the like, but the present invention is not limited thereto.

In one example embodiment of the present invention, the anolyte spacer 23 is a space containing an anolyte, serving to increase the residence time of the anolyte in the apparatus, and located between the anode and an ion exchange membrane to be described below. The second electrolyte may be previously loaded as an anolyte in the anolyte space, and as the oxidation fuel is supplied, when a nitrogen compound-dissolved electrolyte comes into contact with the anode, the excess electrolyte may be moved to the anolyte spacer and loaded.

Here, the low-power electrochemical apparatus for producing a synthetic gas according to the present invention adjusts the width (d) of the anolyte spacer 23, that is, the distance between the anode and the ion exchange membrane. As a result of measuring the change in voltage and current density according to the width (d) of the anolyte space 23, the inventors confirmed that, as shown in FIG. 4, when the width (d) is 10 cm, the current density was low even with an increase in voltage, whereas when the width (d) becomes smaller, the electrical conductivity is increased by increasing the size of the current density at the same voltage. Therefore, the width (d) of the anolyte spacer 23 is preferably less than 10 cm, and more preferably 5 cm or less, and even more preferably 1.5 cm or less.

At the interface between the anolyte spacer 23 and the anode 22, the nitrogen compound is oxidized to produce nitrogen ($N_2$), and thus a second outlet 25 discharging the produced nitrogen may be included at one end of the anolyte spacer 23.

In addition, the low-power electrochemical apparatus for producing a synthetic gas according to the present invention includes an ion exchange unit which includes an ion exchange membrane 30 located between the cathode and the anode.

In one example embodiment of the present invention, the ion exchange membrane serves to selectively deliver cations or anions in an ionic state to the electrode at the opposite side, and a cation exchange membrane, an anion exchange membrane, or a mixed membrane in which a cation exchange membrane and an anion exchange membrane are combined may be used.

In one example embodiment of the present invention, the cation exchange membrane may include any one or more selected from the group consisting of polyvinylidene fluoride (PVDF), polyamide, polyester, polysulfone, polyethylene, polypropylene, styrene, acrylic acid, methacrylic acid, glycidyl acrylate, glycidyl methacrylate, polyethylene glycol diacrylate, 1,3-butylene glycol diacrylate, ethylene glycol dimethacrylate, and cellulose.

In one example embodiment of the present invention, the cation exchange membrane plays a role of a separator that prevents a reducing material or intermediate generated at the cathode from being oxidized by catalysis by moving to the anode, and a separation phase that inhibits the permeation of anions and enables the permeation of cations.

In the present invention, as the cation exchange membrane, any membrane in which cations are conductive, which is known in the art, may be used without limitation. Specifically, the cation exchange membrane may be a porous film, a non-woven fabric, a woven fabric, paper, non-woven paper, or an inorganic membrane. Materials for the cation exchange membrane may be, but are not particularly limited to, a thermoplastic resin, a thermosetting resin, an inorganic substance, and a mixture thereof.

In addition, as the cation exchange membrane, a fluorine-based membrane or a hydrocarbon-based membrane is preferably used in terms of excellent mechanical strength, chemical stability and drug resistance, and high affinity to an anionic exchange resin.

In one example embodiment of the present invention, the cation exchange membrane may be obtained as a commercial product, for example, under the trade name Nafion (Dupont) or Fumapem (FuMA-Tech GmbH).

In one example embodiment of the present invention, the anion exchange membrane may refer to a separation phase enabling permeation of anions such as $OH^-$, $HCO_3^-$, or $CO_3^{2-}$, may include one or more of a fluorine-based material or a hydrocarbon-based material, and for example, a hydrocarbon-based material, such as a quaternary ammonium base, a pyridinium base, an imadazolium base, a tertiary amino group, or a phosphonium group.

In one example embodiment of the present invention, the anion exchange membrane may be obtained as a commercial product, for example, under the trade name A201 (Tokuyama Co. Ltd.), Fumasep (FuMA-Tech GmbH), or Aciplex (Asahi Chemical Industry Co.).

The low-power electrochemical apparatus for producing a synthetic gas according to the present invention uses the anion exchange membrane to deliver OH ions with high efficiency to significantly improve the selectivity for carbon monoxide, thereby having an effect of increasing the production efficiency of carbon monoxide.

In one example embodiment of the present invention, the mixed membrane includes both a cation exchange membrane and an anion exchange membrane, and includes an anion exchange membrane in contact with the cathode 12 and a cation exchange membrane in contact with the anode 22 between the cathode 12 and the anode 22, and the anion exchange membrane and the cation exchange membrane are in contact with each other to have a junction structure.

In one example embodiment of the present invention, the thickness of the ion exchange membrane may be 1 to 150 μm, for example, 50 to 100 μm, or 50 μm.

In addition, the low-power electrochemical apparatus for producing a synthetic gas according to the present invention includes a power unit that supplies power to the cathode 12 and the anode 22.

By the power unit, the reduction reaction of carbon dioxide at the cathode may lead to the oxidation reaction of a nitrogen compound at the anode.

The power unit my apply constant current having a current density of 1 mA $cm^{-2}$ to 10 A $cm^{-2}$.

The reaction scheme of the low-power electrochemical apparatus for producing a synthetic gas according to the present invention is the same as the following Reaction Scheme 2:

Cathode: $CO_2+2H^++2e^-\rightarrow CO(g)+H_2O$ (−0.53 V vs. RHE)

$H^++e^-\rightarrow H_2$ (0.00 V vs. RHE)

Anode: $2NH_3+6OH^-\rightarrow N_2+6H_2O+6e^-$ (0.06 V vs RHE). [Reaction Scheme 2]

Referring to Reaction Scheme 2, the theoretical on-set voltage of the system for simultaneously converting carbon dioxide and a nitrogen compound of the present invention is (−0.53 V)−(0.06 V)=−0.59 V.

The calculation method of an electrochemical conversion product according to the Faraday's law is the same as the following Equation 2:

$$n = \frac{\int_0^{\tau} I(\tau)d\tau}{F \times z} \quad \text{[Equation 2]}$$

(In Equation 2, n is a product (gmol)), and $\int_0^{\tau} I(\tau)d\tau$ is the sum of currents flowing through a converter as much as time τ, F is the Faraday constant (96,500 C/gmol), and z is the number of electrons consumed in a unit electrochemical reaction).

Referring to theoretical on-set voltages deduced from Reaction Schemes 1 and 2 and Equations 1 and 2, when the amount of a product obtained by carbon dioxide conversion is constant, that is, when a constant current value is applied, the low-power electrochemical apparatus for producing a synthetic gas according to the present invention oxidizes the nitrogen compound at the anode to lower a driving voltage compared to the conventional carbon dioxide conversion system, so it can be confirmed that the energy consumption amount is significantly lower than that of the conventional carbon dioxide conversion system with a high driving voltage.

In addition, generally, when a high voltage is applied to a carbon dioxide conversion system, the corrosion of components may occur, and the low-power electrochemical apparatus for producing a synthetic gas according to the present invention may exhibit an effect of inhibiting the corrosion problem of an electrode material by reducing a driving voltage.

Further, in the low-power electrochemical apparatus for producing a synthetic gas according to the present invention, since the reduction of carbon dioxide at the cathode and the oxidation of a nitrogen compound at the anode are performed at the same time, an energy consumption amount can be effectively reduced during driving, carbon dioxide conversion efficiency can be improved by 30% or more compared to the conventional carbon dioxide conversion system, and a synthetic gas having a desired $H_2/CO$ ratio can be produced by controlling the $H_2/CO$ ratio of the produced synthetic gas, and the durability of an electrode can increase by reducing a driving voltage.

In addition, by the low-power electrochemical apparatus for producing a synthetic gas according to the present invention, carbon dioxide and a nitrogen compound can be decomposed at the same time to prevent various environmental influences such as global warming due to carbon dioxide and the acidification of the ocean, can inject industrial waste water and agricultural waste water containing a nitrogen compound such as ammonia into an oxidation fuel to purify the industrial waste water and the agricultural waste water, thus inhibiting water pollution and making a considerable contribution to the environment. Furthermore, the produced synthetic gas may be converted into other high value-added energy resources.

In addition, another aspect of the present invention provides a method of producing a $H_2/CO$ ratio-controlled synthetic gas using the low-power electrochemical apparatus for producing a synthetic gas.

Specifically, the method of producing a $H_2/CO$ ratio-controlled synthetic gas includes providing the low-power electrochemical apparatus for producing a synthetic gas (S10);

injecting a reduction fuel containing carbon dioxide into a first supply unit of the low-power electrochemical apparatus for producing a synthetic gas, and an oxidation fuel containing a nitrogen compound into a second supply unit thereof (S20); and producing a synthetic gas containing $H_2$ and CO by simultaneously converting both of the carbon dioxide and the nitrogen compound by applying a constant current to an anode and a cathode of the low-power electrochemical apparatus for producing a synthetic gas (S30), wherein the $H_2/CO$ ratio-controlled synthetic gas is produced by adjusting the concentration of the injected nitrogen compound and the current density of the applied constant current.

Hereinafter, the method of producing a $H_2/CO$ ratio-controlled synthetic gas according to the present invention will be described in detail step by step.

First, S10 is for providing a low-power electrochemical apparatus for producing a synthetic gas. The present invention is characterized by a low-power electrochemical apparatus for producing a synthetic gas, and since the specific configuration is the same as described above, detailed description will be omitted to avoid overlapping description.

Next, S20 is for injecting fuels into the low-power electrochemical apparatus for producing a synthetic gas. The low-power electrochemical apparatus for producing a synthetic gas includes a first supply unit supplying a reduction fuel containing carbon dioxide to the cathode and a second supply unit supplying an oxidation fuel containing a nitrogen compound to the anode. Here, a reduction fuel containing carbon dioxide, for example, a first electrolyte in which carbon dioxide is dissolved may be injected into the first supply unit, and an oxidation fuel containing a nitrogen compound, for example, a second electrolyte in which a nitrogen compound is dissolved or industrial waste water or agricultural waste water in which a nitrogen compound is dissolved is injected into the second supply unit.

Here, the nitrogen compound may be any one selected from the group consisting of ammonia ($NH_3$), urea, uric acid, biuret, dimethyl urea, hydrazine, urea formaldehyde ($H_2N—COONH_4$), $HNO_3$, $NO_2$, NO, $N_2O_3$, and a combination thereof, and for example, ammonia.

Here, since the concentration of the nitrogen compound in the oxidation fuel preferably ranges from 0.1 to 30 wt %, the $H_2/CO$ ratio of the synthetic gas produced within the above range may be effectively adjusted, and when outside the above range, there is a problem in that this action is not performed properly.

The supplied flow rates of the reduction fuel and oxidation fuel injected into the first supply unit and second supply unit are preferably maintained at 15 to 35 ml/min, and in this range, it may be suitable for the current density to stabilize and for the overall faradaic efficiency to be adequately maintained.

Then, S30 is for producing a synthetic gas containing $H_2$ and CO by converting carbon dioxide and nitrogen compound at the same time by applying a constant current to the anode and cathode of the low-power electrochemical apparatus for producing a synthetic gas.

The constant current may be applied by a power unit of the low-power electrochemical apparatus for producing a synthetic gas.

Here, the current density of the applied constant current is adjusted to produce a $H_2/CO$ ratio-controlled synthetic gas.

The current density of the applied constant current may be used in a range of 1 mA $cm^{-2}$ to 10 A $cm^{-2}$, and the $H_2/CO$ ratio of the produced synthetic gas may be 0.25 to 30.

As such, the low-power electrochemical apparatus for producing a synthetic gas according to the present invention produces a synthetic gas by injecting a reduction fuel containing carbon dioxide into the first supply unit, injecting an oxidation fuel containing a nitrogen compound into the second supply unit, and converting the carbon dioxide by supplying a constant current to a cathode and an anode, and a synthetic gas having a desired $H_2/CO$ ratio may be customized by controlling the $H_2/CO$ ratio of the synthetic gas produced by adjusting the concentration of the nitrogen compound and the current density of the constant current.

Hereinafter, preferred examples and experimental examples are suggested to help in understanding the present invention. However, the following example and experimental examples are merely provided to more easily understand the present invention, and the present invention is not limited to the following examples.

Examples 1 to 3: Manufacture of Apparatus for Manufacturing Low-Power Electrochemical Synthetic Gas

Example 1

A cathode 12 was manufactured by applying an Au catalyst onto an electrode support with a size of 3×3 cm, and an anode 22 was manufactured by applying a Pt catalyst onto an electrode support with a size of 3×3 cm. As shown in FIG. 1, after a cathode unit flow plate having a $CO_2$ inlet 11 and a flow channel as a first supply unit 10 and an anode unit flow plate having an anolyte and $NH_3$ inlet 21, a flow channel and an outlet 24 as a second supply unit 20 were respectively bound to the cathode 12 and the anode 22, a cation exchange membrane 30 (proton exchange membrane (PEM)) with a thickness of 100 μm was formed between the cathode 12 and the anode 22, a catholyte spacer having a synthetic gas outlet was included between the cathode and the cation exchange membrane, and an anolyte spacer 23 having a $N_2$ and $O_2$ outlet 25 was included between the anode 22 and the cation exchange membrane 30. Here, the width (d) of each of the catholyte spacer and the anolyte spacer was 1.3 cm. Hereinafter, a unit cell was manufactured by sealing parts with a gasket 40.

Example 2

A unit cell was manufactured in the same manner as in Example 1, except that the widths (d) of a catholyte spacer and an anolyte spacer were 0.1 cm.

Example 3

A unit cell was manufactured in the same manner as in Example 1, except that the widths (d) of a catholyte spacer and an anolyte spacer were 3.2 cm.

Example 4

A unit cell was manufactured in the same manner as in Example 1, except that the widths (d) of a catholyte spacer and an anolyte spacer were 5.0 cm.

Example 5

A unit cell was manufactured in the same manner as in Example 1, except that the widths (d) of a catholyte spacer and an anolyte spacer were 9.2 cm.

Comparative Example 1

A unit cell was manufactured in the same manner as in Example 1, except that the widths (d) of a catholyte spacer and an anolyte spacer were 10 cm.

Experimental Example 1: LSV Measurement

A 0.5 M $KHCO_3$ aqueous solution in which carbon dioxide was saturated was injected into the cathode of each of the unit cells manufactured in Examples 1 and 2 and Comparative Example 1 at a rate of 20 ml/min and a 0.5 M $KHCO_3$ aqueous solution which did not contain ammonia or contained 2.0 M ammonia was injected into the anode at a rate of 30 ml/min to generate a synthetic gas by carbon dioxide conversion. Here, linear sweep voltammetry (LSV) of the cathode of the unit cell was measured by changing the voltage of the cathode at a rate of 0.1 V/s, and the result is shown in FIGS. 2 to 4.

Figure 2:
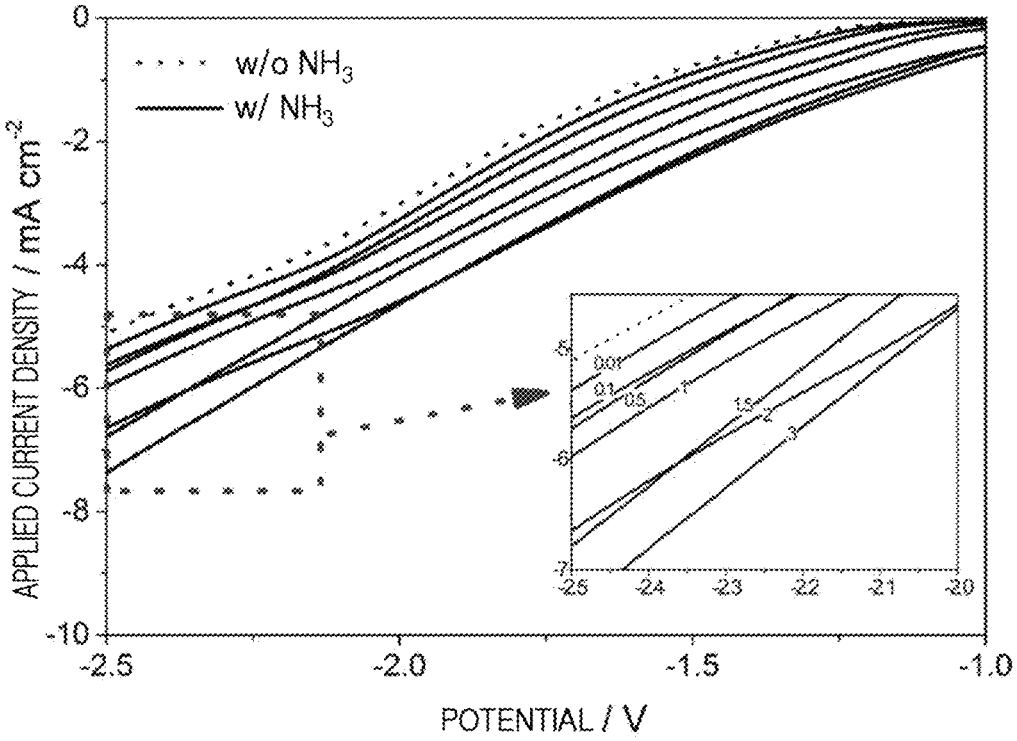
FIG. 2 is a graph showing the result of linear sweep voltammetry (LSV) for the voltage of a positive electrode according to the concentration of a nitrogen compound ($NH_3$) when the distance (d) between the electrode and an ion exchange membrane is 10 cm in a low-power electrochemical apparatus for producing a synthetic gas according to one example embodiment of the present invention.

FIG. 2 is a graph showing the change in current density according to a voltage applied to the anode depending on an ammonia concentration in the unit cell (d=10 cm) manufactured in Comparative Example 1.

Figure 3:
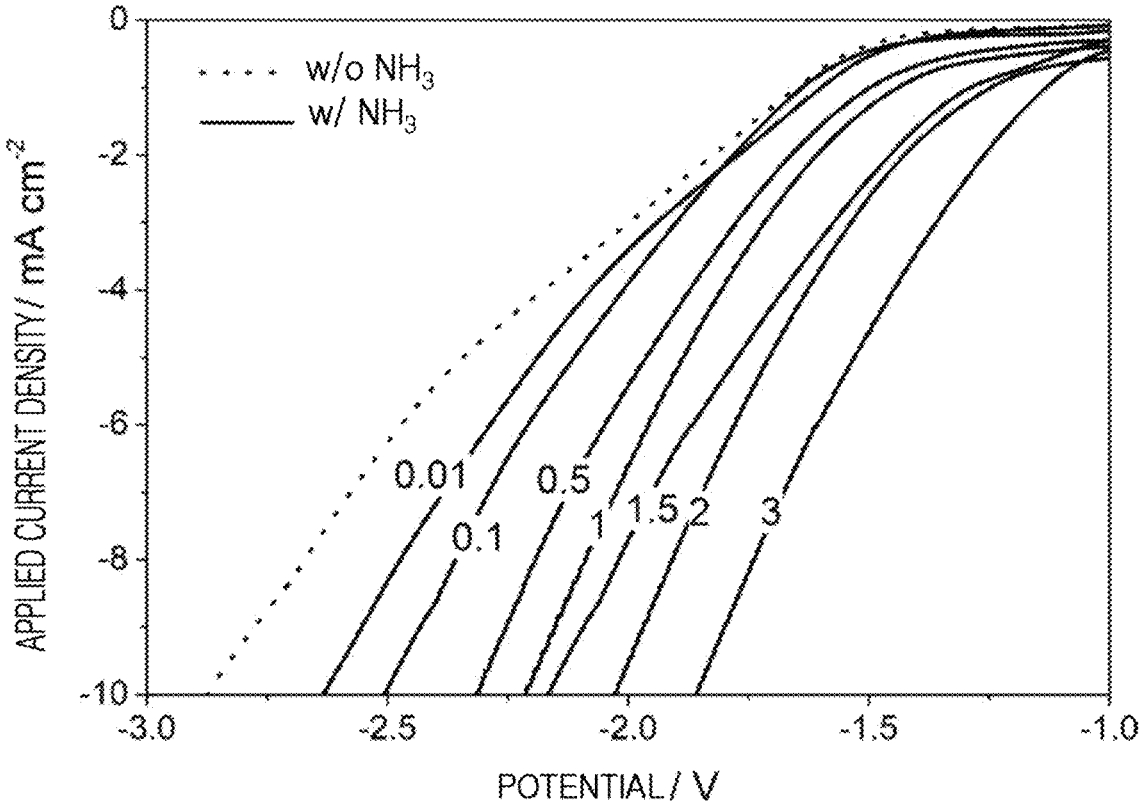
FIG. 3 is a graph showing the result of linear sweep voltammetry (LSV) for the voltage of a positive electrode according to the concentration of a nitrogen compound ($NH_3$) when the distance (d) between the electrode and an ion exchange membrane is less than 10 cm in a low-power electrochemical apparatus for producing a synthetic gas according to one example embodiment of the present invention.

FIG. 3 is a graph showing the change in current density according to a voltage applied to the anode depending on an ammonia concentration in the unit cell (d=1.3 cm) manufactured in Comparative Example 1.

FIG. 4 is a graph showing the change in current density according to a voltage applied when ammonia is included depending on the value of d in the unit cells manufactured in Examples 1 and 2 and Comparative Example 1.

Referring to FIGS. 2 to 4, it can be seen that, in the electrochemical apparatus for producing a synthetic gas according to the present invention, as the ammonia concentration increases and the distance (d) between an electrode and an ion exchange membrane decreases to less than 10 cm, a cell potential is much lower, so that a synthetic gas may be produced even with low power.

Experimental Example 2: Measurement of Driving Voltage and Synthetic Gas Conversion Efficiency A 0.5 M $KHCO_3$ aqueous solution in which carbon dioxide was saturated was injected into the cathode of the unit cell manufactured in Example 1 at a rate of 20 ml/min and a 0.5 M $KHCO_3$ aqueous solution not containing ammonia or containing 2.0 M ammonia was injected into the anode therein at a rate of 30 ml/min to generate a synthetic gas by carbon dioxide conversion. Here, a constant current of 10, 30, 50, 75 or 100 $mA/cm^2$ was applied to the unit cell for one hour, and a driving voltage and synthetic gas (hydrogen and carbon monoxide) conversion efficiency were then measured. The results are shown in FIGS. 5 to 8.

FIG. 5 is a graph showing a cell voltage by applied current density depending on the presence or absence of $NH_3$ in an anolyte in the low-power electrochemical apparatus for producing a synthetic gas according to one example embodiment of the present invention.

FIG. 6 is a graph showing the conversion rate of a synthetic gas ($H_2$/CO) by applied current density when $NH_3$ is not contained in an anolyte in the low-power electrochemical apparatus for producing a synthetic gas according to one example embodiment of the present invention.

FIG. 7 is a graph showing a conversion rate of synthetic gas ($H_2$/CO) by applied current density when 2M $NH_3$ is contained in an anolyte in the low-power electrochemical apparatus for producing a synthetic gas according to one example embodiment of the present invention.

Figure 8:
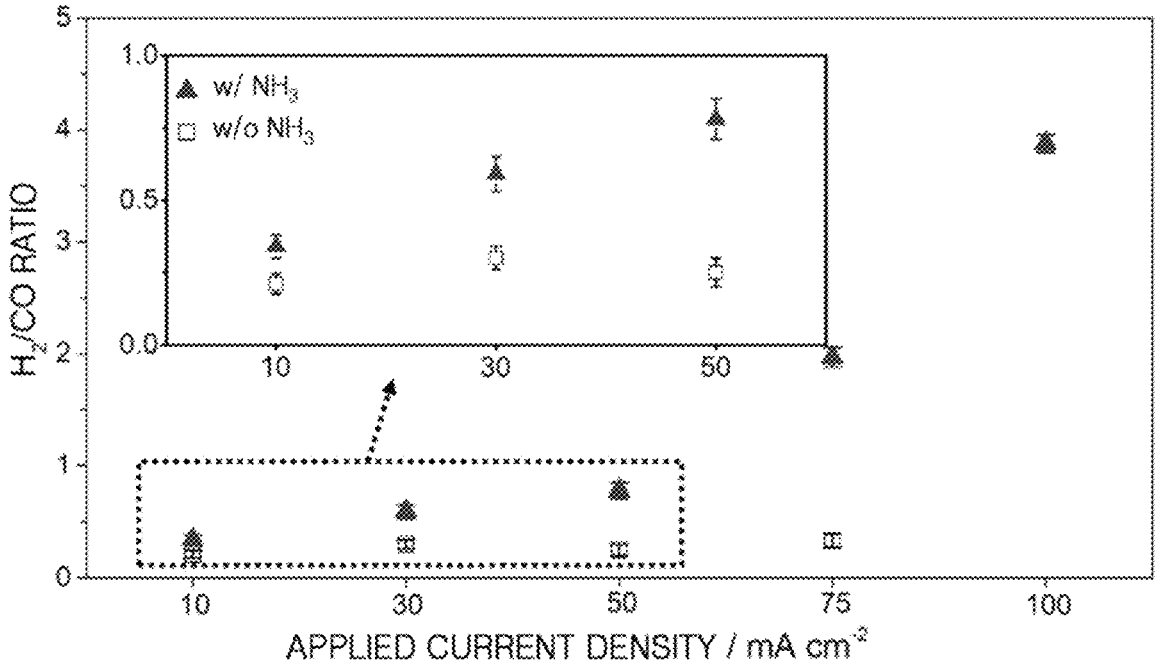
FIG. 8 is a graph showing a conversion rate of synthetic gas ($H_2$/CO) by applied current density depending on the presence or absence of a nitrogen compound ($NH_3$) contained in an anolyte in a low-power electrochemical apparatus for producing a synthetic gas according to one example embodiment of the present invention.

FIG. 8 is a graph showing a conversion rate of synthetic gas ($H_2$/CO) by applied current density depending on the presence or absence of $NH_3$ in an anolyte in the low-power electrochemical apparatus for producing a synthetic gas according to one example embodiment of the present invention.

As shown in FIG. 5, it can be confirmed that, in the electrochemical apparatus for producing a synthetic gas according to the present invention, by adding ammonia to the anolyte, a lower driving voltage is exhibited at the total current density compared to when no ammonia is added.

In addition, as shown in FIGS. 6 to 8, it was confirmed that, in the electrochemical apparatus for producing a synthetic gas according to the present invention, when 2M ammonia is added to an anolyte, an overall synthetic gas ($H_2$/CO) conversion rate is improved by approximately 30% or more when ammonia is not added, and the synthetic gas ($H_2$/CO) conversion rate linearly increases according to a current density.

Accordingly, in the electrochemical apparatus for producing a synthetic gas, a synthetic gas may be produced with a lower driving voltage by adding 2M ammonia in an anolyte, and since the conversion rate of the synthetic gas may be adjusted according to a current density, a desired ratio of the synthetic gas may be customized.

According to one example embodiment of the present invention, as the oxygen generation reaction, which is an anode reaction of a conventional carbon dioxide conversion system, is replaced with an oxidation reaction of a nitrogen compound, a theoretical on-set voltage is lowered to allow a system to be driven with low power, so the amount of energy consumption of the system can be effectively reduced, and the carbon dioxide, which is greenhouse gas, and the nitrogen compound, which is a serious water pollutant, can be removed by a reduction reaction of the carbon dioxide occurring at a cathode and an oxidation reaction of the nitrogen compound occurring at an anode, and a valuable synthetic gas can be produced.

In addition, in a low-power electrochemical apparatus for producing a synthetic gas according to the present invention, by performing the reduction of the carbon dioxide at the cathode and the oxidation of the nitrogen compound at the anode at the same time, carbon dioxide conversion efficiency can be improved 30% or more compared to the conventional carbon dioxide conversion system and a synthetic gas with a desired $H_2$/CO ratio can be produced by controlling the $H_2$/CO ratio of the produced synthetic gas, and the corrosion problem of electrode materials can be inhibited and the durability of electrodes can be increased by reducing a driving voltage.

The effects of the present invention are not limited to the above-described effects, and it should be understood to include all effects that can be inferred from the configuration of the present invention described in the detailed description or claims of the present invention.

It should be understood by those of ordinary skill in the art that the above description of the present invention is exemplary, and the example embodiments disclosed herein can be easily modified into other specific forms without changing the technical spirit or essential features of the present invention. Therefore, it should be interpreted that the example embodiments described above are exemplary in all aspects, and are not limitative. For example, each component described as a single unit may be distributed and implemented, and components described as being distributed may also be implemented in a combined form.

The scope of the present invention is defined by the appended claims and encompasses all modifications and alterations derived from meanings, the scope and equivalents of the appended claims.

DESCRIPTION OF REFERENCE NUMERALS

10: first supply unit
11: reduction fuel inlet
12: cathode
13: catholyte spacer
14: first outlet
20: second supply unit
21: oxidation fuel inlet
22: anode
23: anolyte spacer
24: oxidation fuel outlet
25: second outlet
30: ion exchange membrane
40: gasket
d: width of catholyte spacer or anolyte spacer.

What is claimed is:

1. A low-power electrochemical apparatus for producing a synthetic gas, comprising:

a cathode unit, which comprises a first supply unit for supplying a carbon dioxide-containing reduction fuel, a cathode for reducing the carbon dioxide, a catholyte spacer in contact with the cathode and containing a catholyte, and a first outlet located at one end of the catholyte spacer and discharging a $H_2$/CO synthetic gas containing $H_2$ and CO by reducing the carbon dioxide-containing reduction fuel;

an anode unit, which comprises a second supply unit for supplying an oxidation fuel containing a nitrogen compound, an anode for oxidizing the nitrogen compound, an anolyte spacer in contact with the anode and containing an anolyte, and a second outlet located at one end of the anolyte spacer and discharging a nitrogen compound-containing oxidation product;

an ion exchange unit, which comprises an ion exchange membrane, interposed between the catholyte spacer and the anolyte spacer; and a power unit for applying a constant current to the cathode and the anode, wherein the cathode and the anode are gas diffusion electrodes comprising a catalyst layer, wherein the catalyst layer of the cathode is Au, wherein the catalyst layer of the anode is Pt, wherein the power unit adjusts a current density of the constant current in a range of 1 mA $cm^{-2}$ to 10 A $cm^{-2}$ to control a $H_2$/CO ratio of the synthetic gas in a range of 0.25 to 30, and as the current density of the constant current increases, the $H_2$ ratio in the discharged $H_2$/CO synthetic gas increases.

2. The apparatus of claim 1, wherein the first supply unit is a bipolar plate in which a reduction fuel inlet and a flow channel are formed, and the second supply unit is a bipolar plate in which an oxidation fuel inlet, a flow channel and an oxidation fuel outlet are formed.

3. The apparatus of claim 2, wherein the bipolar plate is at least one selected from the group consisting of graphite, aluminum (Al), stainless steel (SUS), titanium (Ti), gold (Au), and a combination thereof.

4. The apparatus of claim 1, wherein the nitrogen compound is selected from the group consisting of ammonia ($NH_3$), urea, uric acid, biuret, dimethyl urea, hydrazine, urea formaldehyde ($H_2N$—$COONH_4$), $HNO_3$, $NO_2$, NO, $N_2O_3$, and a combination thereof.

5. The apparatus of claim 1, wherein a concentration of the nitrogen compound in the oxidation fuel ranges from 0.1 to 30 wt %.

6. The apparatus of claim 1, wherein the catholyte and the anolyte are each independently selected from the group consisting of $KHCO_3$, $K_2CO_3$, KOH, KCl, $KClO_4$, $K_2SiO_3$, $Na_2SO_4$, $NaNO_3$, NaCl, NaF, $NaClO_4$, $CaCl_2$), and a combination thereof.

7. The apparatus of claim 1, wherein the catholyte spacer and the anolyte spacer have a width of less than 10 cm.

8. The apparatus of claim 7, wherein the catholyte spacer and the anolyte spacer have a width of 5 cm or less.

9. The apparatus of claim 7, wherein the catholyte spacer and the anolyte spacer have a width of 1.5 cm or less.

* * * * *